US009945069B2

(12) United States Patent
Nakamura et al.

(10) Patent No.: US 9,945,069 B2
(45) Date of Patent: Apr. 17, 2018

(54) TREATMENT COMPRISING WATER- AND OIL-REPELLENT AGENT

(75) Inventors: Hisako Nakamura, Settsu (JP); Mitsuhiro Usugaya, Settsu (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 752 days.

(21) Appl. No.: 12/446,120

(22) PCT Filed: Oct. 17, 2007

(86) PCT No.: PCT/JP2007/070677

§ 371 (c)(1), (2), (4) Date: Apr. 17, 2009

(87) PCT Pub. No.: WO2008/050780

PCT Pub. Date: May 2, 2008

(65) Prior Publication Data

US 2010/0316835 A1 Dec. 16, 2010

Related U.S. Application Data

(60) Provisional application No. 60/852,974, filed on Oct. 20, 2006.

(51) Int. Cl.

| | |
|---|---|
| ***D06M 15/53*** | (2006.01) |
| ***D06M 23/00*** | (2006.01) |
| ***D06N 7/00*** | (2006.01) |
| ***D06M 13/236*** | (2006.01) |
| ***D06M 13/408*** | (2006.01) |
| ***D06M 13/428*** | (2006.01) |
| ***D06M 15/05*** | (2006.01) |
| ***D06M 15/09*** | (2006.01) |
| ***D06M 15/244*** | (2006.01) |
| ***D06M 15/263*** | (2006.01) |
| ***D06M 15/277*** | (2006.01) |
| ***D06M 15/285*** | (2006.01) |
| ***D06M 15/29*** | (2006.01) |
| ***D06M 15/295*** | (2006.01) |
| ***D06M 15/333*** | (2006.01) |
| ***D06M 15/347*** | (2006.01) |
| ***D06M 15/576*** | (2006.01) |

(52) U.S. Cl.

CPC ..... *D06M 15/53* (2013.01); *D06M 13/236* (2013.01); *D06M 13/408* (2013.01); *D06M 13/428* (2013.01); *D06M 15/05* (2013.01); *D06M 15/09* (2013.01); *D06M 15/244* (2013.01); *D06M 15/263* (2013.01); *D06M 15/277* (2013.01); *D06M 15/285* (2013.01); *D06M 15/29* (2013.01); *D06M 15/295* (2013.01); *D06M 15/333* (2013.01); *D06M 15/347* (2013.01); *D06M 15/576* (2013.01); *D06M 23/00* (2013.01); *D06N 7/0065* (2013.01); *D06M 2200/01* (2013.01); *D06M 2200/11* (2013.01); *D06M 2200/12* (2013.01); *D06N 2209/146* (2013.01); *D06N 2209/147* (2013.01); *Y10T 428/23986* (2015.04); *Y10T 442/2172* (2015.04)

(58) Field of Classification Search

CPC .... D06M 15/05; D06M 15/09; D06M 15/244; D06M 15/256; D06M 2200/01; D06M 2200/11; D06M 2200/12; D06M 23/00; D06N 7/0065; D06N 2209/146; D06N 2209/147; Y10T 428/23986; Y10T 442/2164; Y10T 442/2172; Y10T 442/2189

USPC ..... 442/79, 80, 82, 86, 88, 91, 92; 428/96; 427/352, 354, 385.5, 389.9, 393.4

See application file for complete search history.

(56) References Cited

U.S. PATENT DOCUMENTS

| | | | | |
|---|---|---|---|---|
| 3,210,336 | A | 10/1965 | Poppelsdorf | |
| 5,073,442 | A | 12/1991 | Knowlton et al. | |
| 5,346,949 | A | 9/1994 | Fukazawa | |
| 5,370,919 | A | 12/1994 | Fieuws et al. | |
| 5,516,337 | A | 5/1996 | Nguyen | |
| 5,520,962 | A | 5/1996 | Jones, Jr. | |
| 5,851,595 | A | 12/1998 | Jones, Jr. | |
| 6,740,357 | B2 * | 5/2004 | Yamaguchi et al. | 427/352 |
| 7,226,952 | B1 | 6/2007 | Okamoto et al. | |
| 2003/0157256 | A1 | 8/2003 | Yamaguchi et al. | |
| 2011/0020591 | A1 * | 1/2011 | Nakamura et al. | 428/96 |
| 2011/0021099 | A1 * | 1/2011 | Nakamura et al. | 442/80 |
| 2011/0028059 | A1 * | 2/2011 | Nakamura et al. | 442/80 |

FOREIGN PATENT DOCUMENTS

| | | | |
|---|---|---|---|
| DE | 2406343 | A * | 8/1974 |
| FR | 2.217.404 | A | 9/1974 |
| JP | 50047000 | A | 4/1975 |
| JP | 50-94294 | A | 7/1975 |
| JP | 53050080 | A | 5/1978 |

(Continued)

*Primary Examiner* — Cheryl Juska

(74) *Attorney, Agent, or Firm* — Sughrue Mion, PLLC

(57) ABSTRACT

A textile having high fluorine adhesion rate, and excellent water- and oil-repellency can be obtained by a method of producing a treated textile, comprising steps of: (1) preparing a treatment liquid comprising a water- and oil-repellent agent which comprises at least one fluorine-containing compound selected from the group consisting of a fluorine-containing polymer or a fluorine-containing low molecular weight compound, (2) adjusting pH of the treatment liquid to at most 7, (3) applying the treatment liquid to a textile, (4) treating the textile with steam, and (5) washing the textile with water and dehydrating the textile, wherein the treatment liquid comprises a thermally gelling substance.

27 Claims, No Drawings

(56) References Cited

FOREIGN PATENT DOCUMENTS

| | | | |
|---|---|---|---|
| JP | 3-193976 | A | 8/1991 |
| JP | 5017538 | A | 1/1993 |
| JP | 06-049319 | A | 2/1994 |
| JP | 6-146172 | A | 5/1994 |
| JP | 6146172 | A | 5/1994 |
| JP | 10-114882 | A | 5/1998 |
| JP | 11-335982 | A | 12/1999 |
| JP | 2000226773 | A | 8/2000 |
| JP | 2001-97812 | A | 4/2001 |
| JP | 3210336 | B2 | 7/2001 |
| JP | 2002-241596 | A | 8/2002 |
| JP | 2003193370 | A | 7/2003 |
| WO | 98/50619 | A1 | 11/1998 |
| WO | WO 0061697 | A1 | 10/2000 |

* cited by examiner

TREATMENT COMPRISING WATER- AND OIL-REPELLENT AGENT

This application claims benefit under 35 U.S.C. § 119(e) of U.S. Provisional Application No. 60/852,974, filed Oct. 20, 2006, incorporated herein by reference in its entirety.

FIELD OF THE INVENTION

The present invention relates to a treatment for imparting excellent water-repellency and oil-repellency to a textile. A method of the present invention is particularly useful for a carpet.

BACKGROUND OF THE INVENTION

Hitherto, various treatment methods have been proposed in order to impart water-repellency, oil-repellency and soil releasability to a textile such as a carpet. For example, a process (hereinafter, sometimes referred to as "Exhaust process") of treating a textile comprising decreasing a pH of a treatment liquid, applying the treatment liquid to the textile, thermally treating the textile with steam, washing the textile with water, and dehydrating the textile is proposed.

A method comprising the Exhaust process is proposed in U.S. Pat. Nos. 5,073,442, 5,520,962, 5,516,337 and 5,851,595 and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. Nos. 5,520,962 and 5,851,595 disclose a method of treating a carpet, comprising conducting an Exhaust process by using a fluorine-containing compound and an acrylic polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt. JP Patent No. 3210336 discloses a method of treating a textile with a fluorine-containing water- and oil-repellent agent and a water-soluble compound such as carboxymethyl cellulose. JP-A-6-49319 (corresponding to U.S. Pat. No. 5,346,949) discloses a fluorine-containing aqueous water- and oil-repellent composition comprising a fluorine-containing polymer and a cationic water-soluble polymer.

Hitherto, when the Exhaust process is performed according to the above-mentioned methods, sufficiently high adhesion rate (adherence efficiency) of water- and oil-repellent agent and excellent water- and oil-repellency cannot be obtained.

DISCLOSURE OF THE INVENTION

An object of the present invention is to give a textile which has a high adhesion rate of a water- and oil-repellent agent and which is excellent in water-repellency and oil-repellency, when the textile is treated with the water- and oil-repellent agent by an Exhaust process.

The present invention provides a method of producing a treated textile, comprising steps of:

(1) preparing a treatment liquid comprising a water- and oil-repellent agent which comprises at least one fluorine-containing compound selected from the group consisting of a fluorine-containing polymer and a fluorine-containing low molecular weight compound, (2) adjusting pH of the treatment liquid to at most 7, (3) applying the treatment liquid to a textile, (4) treating the textile with steam, and (5) washing the textile with water and dehydrating the textile, wherein the water- and oil-repellent agent or the treatment liquid comprises a thermally gelling substance, or, in the step (3), the thermally gelling substance is used in addition to the treatment liquid and the thermally gelling substance is applied to the textile with contacting the thermally gelling substance with the treatment liquid.

The present invention also provides a water- and oil-repellent composition comprising:

(i) at least one fluorine-containing compound selected from the group consisting of a fluorine-containing polymer and a fluorine-containing low-molecular weight compound, and (ii) a thermally gelling substance.

The procedure used in the present invention is an Exhaust process which comprises decreasing pH of a treatment liquid comprising a water- and oil-repellent agent, applying a treatment liquid to a textile, thermally treating (or heating) the textile, washing the textile with water, and dehydrating the textile.

In the step (1) of the method of the present invention, the treatment liquid comprising the water- and oil-repellent agent, which is applied to the textile, is prepared. The treatment liquid comprising the water- and oil-repellent agent may be in the form of a solution or an emulsion, particularly an aqueous emulsion.

The treatment liquid may contain a stain blocking agent in addition to the water- and oil-repellent agent comprising at least one fluorine-containing compound selected from the group consisting of the fluorine-containing polymer or the fluorine-containing low molecular weight compound.

The stain blocking agent preferably includes a phenol/formaldehyde condensate, an acrylic polymer and a mixture of the phenol/formaldehyde condensate and the acrylic polymer. Examples of the phenol/formaldehyde condensate include a sulfonated phenol resin. Examples of the acrylic polymer include a methacrylic acid-based polymer, for example, a homopolymer of methacrylic acid, and a copolymer of methacrylic acid such as methacrylic acid/butyl methacrylate copolymer and a methacrylic acid copolymer containing styrene. The amount of the stain blocking agent may be, for example from 0 to 1,000 parts by weight, particularly from 1 to 500 parts by weight, based on 100 parts by weight of the fluorine-containing compound.

In the step (2) in the method of the present invention, pH of the treatment liquid is brought to at most 7. The pH of the treatment liquid is for example at most 5, e.g. at most 4, particularly at most 3, especially at most 2. The pH can be decreased by addition of an acid such as an aqueous solution of citraconic acid and an aqueous solution of sulfamic acid to the treatment liquid.

In the step (3) of the method of the present invention, the treatment liquid is applied to the textile. The water- and oil-repellent agent can be applied to a substrate to be treated (that is, the textile) by known procedures. The application of the treatment liquid can be conducted by immersion, spraying and coating. Usually, the treatment liquid is diluted with an organic solvent or water, and is adhered to surfaces of the substrate by a well-known procedure such as an immersion coating, a spray coating and a foam coating to a fabric (for example, a carpet cloth), a yarn (for example, a carpet yarn)

or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid. The concentration of the water- and oil-repellent agent active component (that is, at least one fluorine-containing compound selected from the group consisting of the fluorine-containing polymer and the fluorine-containing low molecular weight compound) in the treatment liquid contacted with the substrate may be from 0.01 to 20% by weight, for example from 0.05 to 10% by weight, based on the treatment liquid.

In the step (4) of the method of the present invention, the textile is thermally treated. The thermal treatment can be conducted by applying a steam (for example, 90 to 110° C.) to the textile under a normal pressure for e.g., 10 seconds to 20 minutes.

In the step (5) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure.

After the step (5), the textile can be dried.

The fluorine-containing polymer may be a polymer comprising a repeating unit derived from a fluoroalkyl group-containing monomer such as a fluoroalkyl group-containing (meth)acrylate, a fluoroalkyl group-containing maleate or fumarate, or a fluoroalkyl group-containing urethane.

The fluoroalkyl group-containing monomer may be, for example, of the formula:

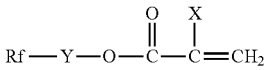

(I)

wherein X is a hydrogen atom, a methyl group, a fluorine atom, a chlorine atom, a bromine atom, a iodine atom, $CFX^1X^2$ group (in which $X^1$ and $X^2$ are a hydrogen atom, a fluorine atom, a chlorine atom, a bromine atom or a iodine atom), a cyano group, a linear or branched fluoroalkyl group having 1 to 21 carbon atoms, a substituted or unsubstituted benzyl group, or a substituted or unsubstituted phenyl group, Y is an aliphatic group having 1 to 10 carbon atoms, an aromatic group or cycloaliphatic group having 6 to 10 carbon atoms, a $—SO_2N(R^1)CH_2CH_2—$ group (in which $R^1$ is an alkyl group having 1 to 4 carbon atoms) or a $CH_2CH(OY^1)CH_2—$ group (in which $Y^1$ is a hydrogen atom or an acetyl group), Rf is a linear or branched fluoroalkyl group having 1 to 21 carbon atoms.

In the formula (I), the Rf group is preferably a perfluoroalkyl group. The carbon number of the Rf group is from 1 to 21, preferably from 1 to 20, particularly from 1 to 6, especially from 1 to 5, for example, from 1 to 4. The specific examples of the Rf group include $—CF_3$, $—CF_2CF_3$, $—CF_2CF_2CF_3$, $—CF(CF_3)_2$, $—CF_2CF_2CF_2CF_3$, $—CF_2CF(CF_3)_2$, $—C(CF_3)_3$, $—(CF_2)_4CF_3$, $—(CF_2)_2CF(CF_3)_2$, $—CF_2C(CF_3)_3$, $—CF(CF_3)CF_2CF_2CF_3$, $—(CF_2)_5CF_3$, $—(CF_2)_3CF(CF_3)_2$, $—(CF_2)_4CF(CF_3)_2$, $—(CF_2)_7CF_3$, $—(CF_2)_5CF(CF_3)_2$, $—(CF_2)_6CF(CF_3)_2$, and $—(CF_2)_9CF_3$.

Y is an aliphatic group having 1 to 10 carbon atoms, an aromatic group or cycloaliphatic group having 6 to 10 carbon atoms, a $—SO_2N(R^1)CH_2CH_2—$ group (in which $R^1$ is an alkyl group having 1 to 4 carbon atoms) or a $CH_2CH(OY^1)CH_2—$ group (in which $Y^1$ is a hydrogen atom or an acetyl group) or a $—SO_2(CH_2)_n—$ group (in which n is from 1 to 10). The aliphatic group is preferably an alkylene group (having particularly 1 to 4, for example 1 or 2 carbon atoms). The aromatic group or cycloaliphatic group may be substituted or unsubstituted.

Examples of the fluorine-containing monomer are as follows:

$Rf\text{-}(CH_2)_{10}OCOCCH{=}CH_2$ $Rf\text{-}(CH_2)_{10}OCOC(CH_3){=}CH_2$ $Rf\text{-}CH_2OCOCH{=}CH_2$ $Rf\text{-}CH_2OCOC(CH_3){=}CH_2$ $Rf\text{-}(CH_2)_2OCOCH{=}CH_2$ $Rf\text{-}(CH_2)_2OCOC(CH_3){=}CH_2$ $Rf\text{-}SO_2N(CH_3)(CH_2)_2OCOCH{=}CH_2$ $Rf\text{-}SO_2N(C_2H_5)(CH_2)_2OCOCH{=}CH_2$ $Rf\text{-}CH_2CH(OCOCH_3)CH_2OCOC(CH_3){=}CH_2$ $Rf\text{-}CH_2CH(OH)CH_2OCOCH{=}CH_2$ $Rf\text{-}SO_2(CH_2)_2OCOCH{=}CH_2$ $Rf\text{-}SO_2(CH_2)_3OCOCH{=}CH_2$

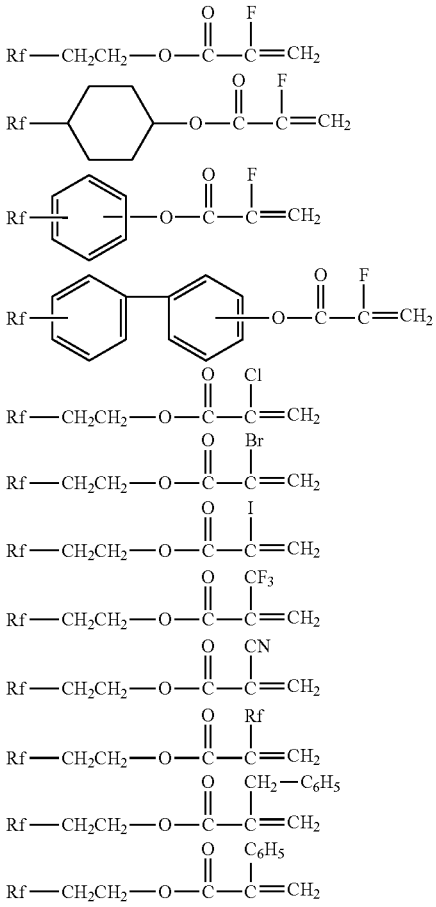

-continued

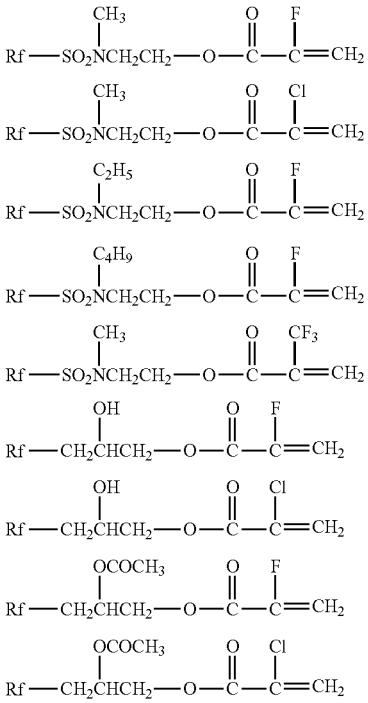

wherein Rf is a linear or branched fluoroalkyl group having 1 to 21 carbon atoms.

The fluorine-containing maleate or fumarate deriving the fluorine-containing polymer include, for example, an OH-containing fluorine-containing maleate represented by the formula:

(I)

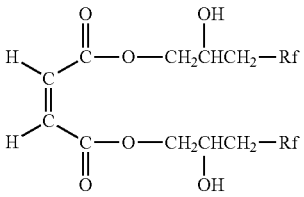

wherein Rf is a perfluoroalkyl group having 1 to 21 carbon atoms;

an OH-containing fluorine-containing fumarate represented by the formula:

(II)

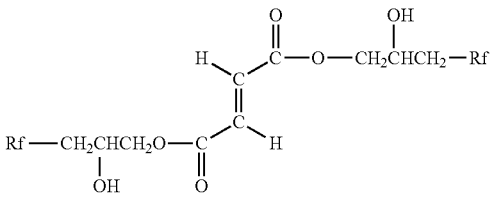

wherein Rf is a perfluoroalkyl group having 1 to 21 carbon atoms;

a fluorine-containing maleate represented by the formula:

(III)

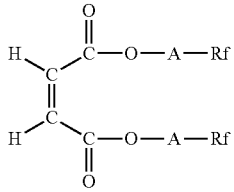

wherein Rf is a perfluoroalkyl group having 1 to 21 carbon atoms;

A is an alkylene group having 1 to 4 carbon atoms, or

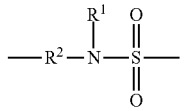

($R^1$ is a hydrogen atom or an alkyl group having 1 to 4 carbon atoms, and $R^2$ is an alkylene group having 1 to 4 carbon atoms); and a fluorine-containing fumarate represented by the formula:

(IV)

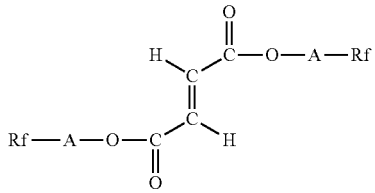

wherein Rf is a perfluoroalkyl group having 1 to 21 carbon atoms;

A is an alkylene group having 1 to 4 carbon atoms, or

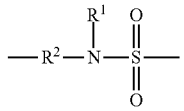

($R^1$ is a hydrogen atom or an alkyl group having 1 to 4 carbon atoms, and $R^2$ is an alkylene group having 1 to 4 carbon atoms).

The fluoroalkyl group-containing urethane monomer deriving the fluorine-containing polymer can be prepared by reacting:

(a) a compound having at least two isocyanate groups, (b) a compound having one carbon-carbon double bond and at least one hydroxyl group or amino group, and (c) a fluorine-containing compound one hydroxyl group or amino group.

Examples of the compound (a) include the followings:

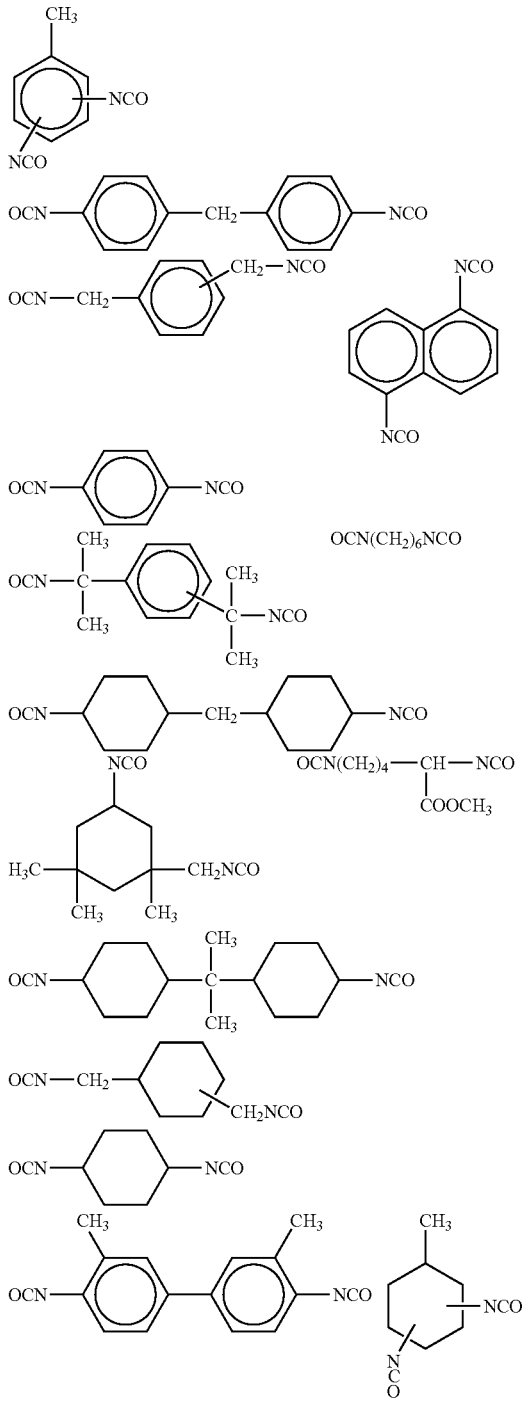

The compound (a) is preferably a diisocyanate. However, a triisocyanate and a polyisocyanate can be also used for the reaction.

For example, a trimer of diisocyanate, polymeric MDI (diphenylmethane diisocyanate) and an adduct of diisocyanate with a polyhydric alcohol such as trimethylol propane, trimethylol ethane and glycerol can be also used for the reaction.

Examples of the triisocyanate and the polyisocyanate are as follows:

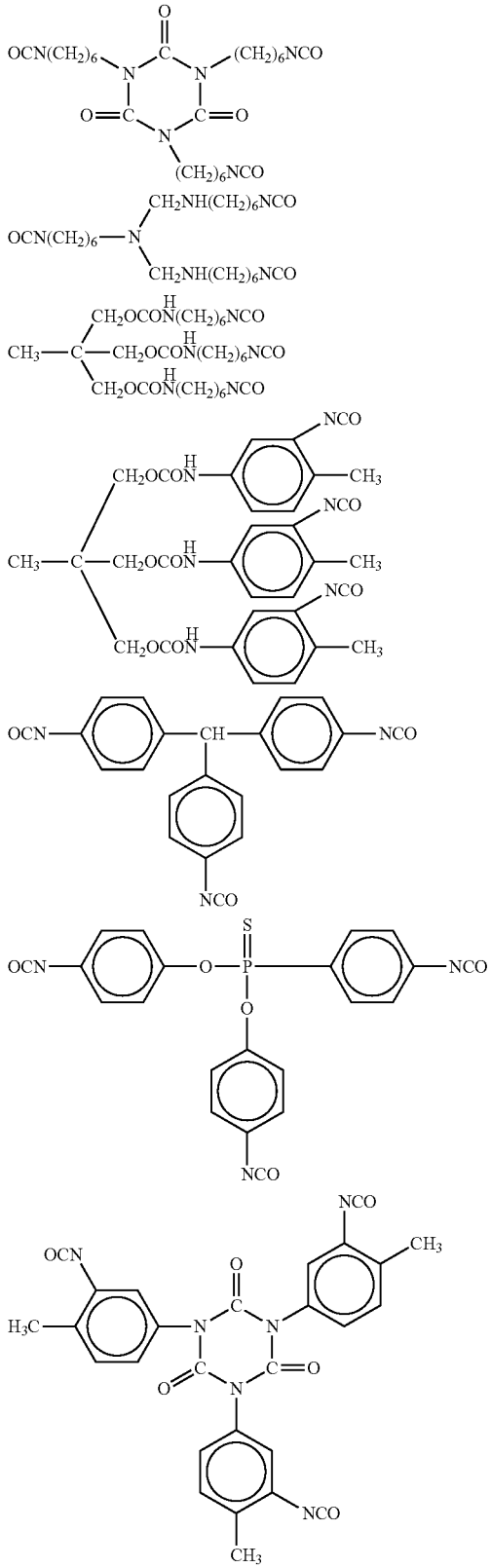

The compound (b) may be, for example, a compound of each of the formulas:

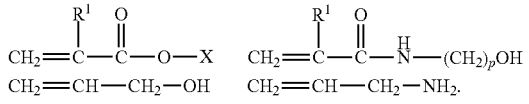

In the formula, $R^1$ is a hydrogen atom or a methyl group. Examples of X are as follows:

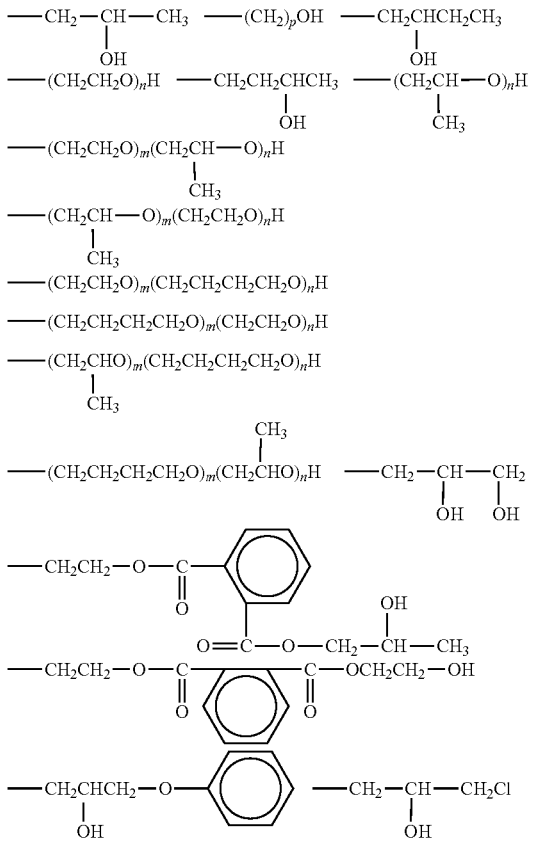

wherein m and n are a number of 1 to 300.

The compound (c) may be a compound of the formula:

$R_f—R^2—OH$, or $R_f—R^2—NH_2$ wherein $R_f$ is a fluoroalkyl group having 1 to 21 carbon atoms, and $R^2$ is an alkylene group having 1 to 10 carbon atoms and may have a heteroatom.

Examples of the compound (c) may be the followings:

$CF_3CH_2OH$ $F(CF_2)_8CH_2CH_2OH$ $F(CF_2)_6(CH_2)_6OH$ $F(CF_2)_8SO_2N(CH_3)CH_2CH_2OH$ $F(CF_2)_3CH_2NH_2$ $F(CF_2)_7CH_2NH_2$

The compounds (a), (b) and (c) may be reacted such that when the compound (a) is a diisocyanate, both the compounds (b) and (c) are in amounts of 1 mol based on 1 mol of the compound (a); when the compound (a) is a triisocyanate, the compound (b) is in an amount of 1 mol and the compound (c) is in an amount of 2 mol based on 1 mol of the compound (a).

The fluorine-containing polymer constituting the water- and oil-repellent agent may comprise:

(I) a repeating unit derived from a monomer having a fluoroalkyl group, and (II) a repeating unit derived from a fluorine-free monomer, or (III) a repeating unit derived from a crosslinkable monomer.

The fluorine-containing polymer constituting the water- and oil-repellent agent may comprise:

(I) a repeating unit derived from a monomer having a fluoroalkyl group, (II) a repeating unit derived from a fluorine-free monomer, and (III) a repeating unit derived from a crosslinkable monomer.

Examples of the monomer having fluoroalkyl group constituting the repeating unit (I) include the same as the above-mentioned fluoroalkyl group-containing monomer such as the fluoroalkyl group-containing (meth)acrylate.

The repeating unit (II) is preferably derived from a fluorine-free olefinically unsaturated monomer. Non-limiting examples of a preferable monomer constituting the repeating unit (II) include, for example, ethylene, vinyl acetate, vinyl halide such as vinyl chloride, vinylidene halide such as vinylidene chloride, acrylonitrile, styrene, polyethyleneglycol (meth)acrylate, polypropyleneglycol (meth)acrylate, methoxypolyethyleneglycol (meth)acrylate, methoxypolypropyleneglycol (meth)acrylate, vinyl alkyl ether and isoprene.

The monomer constituting the repeating unit (II) may be a (meth)acrylate ester having an alkyl group. The number of carbon atoms of the alkyl group may be from 1 to 30, for example, from 6 to 30, e.g., from 10 to 30. For example, the monomer constituting the repeating unit (II) may be acrylates of the general formula:

$$CH_2{=}CA^1COOA^2$$

wherein $A^1$ is a hydrogen atom or a methyl group, and $A^2$ is an alkyl group represented by $C_nH_{2n+1}$ (n=1 to 30).

The repeating unit (II) preferably contains vinyl halide or vinylidene halide.

The presence of the repeating unit (II) can optionally improve various properties such as water-repellency and soil releasability; cleaning durability, washing durability and abrasion resistance of said repellency and releasability; solubility in solvent; hardness; and feeling.

The crosslinkable monomer constituting the repeating unit (III) may be a fluorine-free (preferably vinyl) monomer having at least two reactive groups and/or carbon-carbon double bonds. The crosslinkable monomer may be a compound having at least two carbon-carbon double bonds, or a compound having at least one carbon-carbon double bond and at least one reactive group.

Examples of the crosslinkable monomer include diacetoneacrylamide, (meth)acrylamide, N-methylolacrylamide, hydroxymethyl(meth)acrylate, hydroxyethyl(meth)acrylate, 3-chloro-2-hydroxypropyl(meth)acrylate, N,N-dimethylaminoethyl (meth)acrylate, N,N-diethylaminoethyl (meth)acrylate, butadiene, chloroprene and glycidyl (meth)acrylate, to which the crosslinkable monomer is not limited. The presence of the repeating unit (III) can optionally improve various properties such as water-repellency and soil releasability; cleaning durability and washing durability of said repellency and releasability; solubility in solvent; hardness; and feeling.

In the present invention, the fluorine-containing polymer is preferably free from an oxyalkylene group.

The fluorine-containing polymer preferably has a weight average molecular weight of for example from 2,000 to 5,000,000, particularly from 3,000 to 5,000,000, especially from 10,000 to 1,000,000.

Preferably, the amount of the repeating unit (II) is from 0 to 200 parts by weight, more preferably from 0.5 to 80 parts by weight, particularly from 1 to 60 parts by weight, and the amount of the repeating unit (III) is from 0 to 30 parts by weight, more preferably from 0.1 to 15 parts by weight, particularly from 0.5 to 10 parts by weight, based on 100 parts by weight of the repeating unit (I).

The fluorine-containing polymer in the present invention can be produced by any polymerization method, and the conditions of the polymerization reaction can be arbitrary selected. The polymerization method includes, for example, solution polymerization and emulsion polymerization. Among them, the emulsion polymerization is particularly preferred.

In the solution polymerization, there can be used a method of dissolving the monomers in an organic solvent in the presence of a polymerization initiator, replacing the atmosphere by nitrogen, and stirring the mixture with heating at the temperature within the range, for example, from 50° C. to 120° C. for 1 hour to 10 hours. Examples of the polymerization initiator include azobisisobutyronitrile, benzoyl peroxide, di-tert-butyl peroxide, lauryl peroxide, cumene hydroperoxide, t-butyl peroxypivalate and diisopropyl peroxydicarbonate. The polymerization initiator may be used in the amount within the range from 0.01 to 5 parts by weight based on 100 parts by weight of the monomers.

The organic solvent is inert to the monomers and dissolves them, and examples thereof include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of whole of the monomers.

In the emulsion polymerization, there can be used a method of emulsifying the monomers in water in the presence of a polymerization initiator and an emulsifying agent, replacing the atmosphere by nitrogen, and copolymerizing with stirring at the temperature within the range, for example, from 50° C. to 80° C. for 1 hour to 10 hours. As the polymerization initiator, for example, water-soluble initiators (e.g., benzoyl peroxide, lauroyl peroxide, t-butyl perbenzoate, 1-hydroxycyclohexyl hydroperoxide, 3-carboxypropionyl peroxide, acetyl peroxide, azobisisobutylamidine dihydrochloride, azobisisobutyronitrile, sodium peroxide, potassium persulfate and ammonium persulfate) and oil-soluble initiators (e.g., azobisisobutyronitrile, benzoyl peroxide, di-tert-butyl peroxide, lauryl peroxide, cumene hydroperoxide, t-butyl peroxypivalate and diisopropyl peroxydicarbonate) are used. The polymerization initiator may be used in the amount within the range from 0.01 to 5 parts by weight based on 100 parts by weight of the monomers.

In order to obtain a copolymer dispersion in water, which is superior in storage stability, it is desirable that the monomers are dispersed in water by using an emulsifying device capable of applying a strong shearing energy (e.g., a high-pressure homogenizer and an ultrasonic homogenizer) and then polymerized with using the water- or oil-soluble polymerization initiator. As the emulsifying agent, various emulsifying agents such as an anionic emulsifying agent, a cationic emulsifying agent and a nonionic emulsifying agent can be used in the amount within the range from 0.5 to 50 parts by weight, for example from 0.5 to 10 parts by weight, based on 100 parts by weight of the monomers. When the monomers are not completely compatibilized, a compatibilizing agent capable of sufficiently compatibilizing them (e.g., a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol, ethanol and N-methyl-2-pyrrolidone. The water-soluble organic solvent may be used in the amount within the range from 1 to 50 parts by weight, e.g., from 10 to 40 parts by weight, based on 100 parts by weight of water.

The fluorine-containing low molecular weight compound may have a molecular weight of less than 2,000, for example, from 500 to 1,500 and may be a fluoroalkyl group-containing compound.

The fluorine-containing low molecular weight compound may be, for example, a fluoroalkyl group-containing urethane or a fluoroalkyl group-containing ester.

The fluoroalkyl group-containing urethane can be prepared by reacting (i) a compound having at least two isocyanate groups, with (ii) a fluorine-containing compound having one hydroxyl group, amino group or epoxy group.

Examples of the compound having at least two isocyanate groups (i) are the same as those of the above-mentioned compound having at least two isocyanate groups (a) used for the fluoroalkyl group-containing urethane monomer deriving the fluorine-containing copolymer.

Specific examples of the fluorine-containing compound having one hydroxyl group, amino group or epoxy group (ii) are as follows:

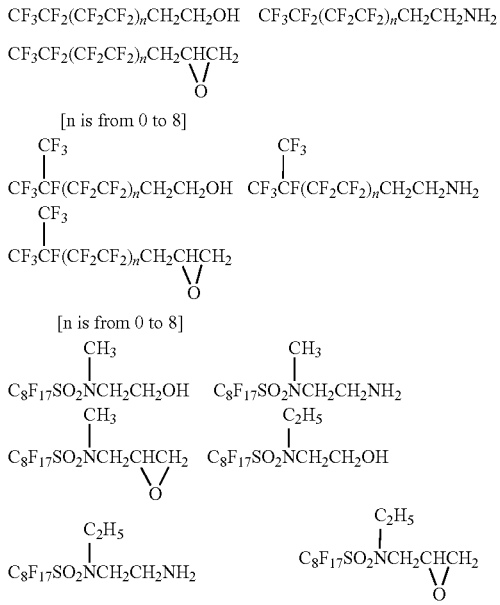

The fluoroalkyl group-containing ester can be prepared by reacting:

(iii) a polybasic carboxylic acid compound, with (ii) a fluorine-containing compound having one hydroxyl group, amino group or epoxy group.

The polybasic carboxylic acid compound is a compound having at least 2, preferably 2 to 4 carboxylic acid groups.

Specific examples of the polybasic carboxylic acid compound are as follows:

$HOOC(CH_2)_nCOOH$

[n is 2, 4 or 6]

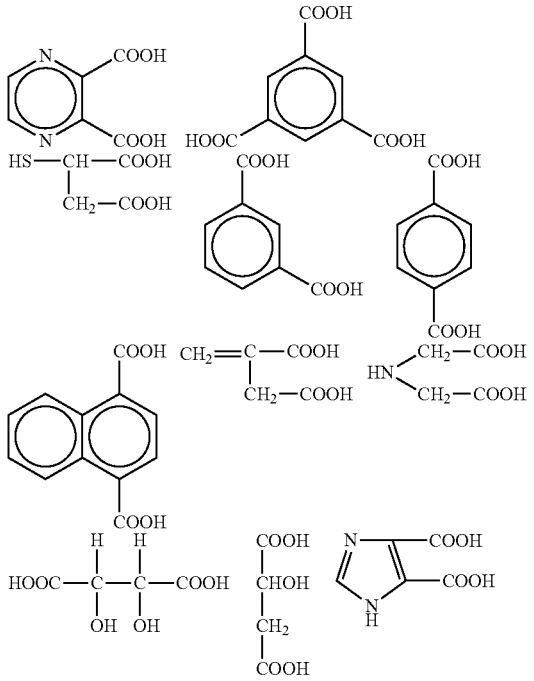

Examples of the fluorine-containing compound having one hydroxyl group, amino group or epoxy group (ii) forming the fluoroalkyl group-containing ester are the same as those of the above-mentioned fluorine-containing compound having one hydroxyl group, amino group or epoxy group (ii) forming the fluoroalkyl group-containing urethane.

The fluorine-containing compound may be the fluorine-containing polymer, the fluorine-containing low molecular weight compound, or a mixture of the fluorine-containing polymer and the fluorine-containing low molecular weight compound.

The amount of the fluorine-containing compound may be at most 80% by weight, particularly from 1 to 60% by weight, based on the water- and oil-repellent agent. The amount of the emulsifier may be from 0.5 to 50 parts by weight, for example from 0.5 to 15 parts by weight, based on 100 parts by weight of the fluorine-containing compound.

In one of embodiments, the treatment liquid used in the step (3) comprises the thermally gelling substance (that is, a material having a property of thermal gelation) in addition to the fluorine-containing compound. The water- and oil-repellent agent may contain the thermally gelling substance, or the thermally gelling substance may be added to the water- and oil-repellent agent. If the water- and oil-repellent agent contains the thermally gelling substance, the thermally gelling substance may be added before the synthesis of the fluorine-containing compound (for example, the polymerization of the fluorine-containing polymer), or the thermally gelling substance may be added to the fluorine-containing compound after the synthesis of the fluorine-containing compound.

In other of embodiments, in the step (3), the thermally gelling substance is used in addition to the treatment liquid, and the thermally gelling substance and the treatment liquid are applied to the textile with contacting the thermally gelling substance with the treatment liquid. The contact of the treatment liquid with the thermally gelling substance can give the same effect as in the case that the treatment liquid contains the thermally gelling substance. Preferably, the thermally gelling substance is dissolved or dispersed in a medium (for example, a liquid such as water and an organic solvent). The concentration of the thermally gelling substance in a solution or dispersion may be from 0.001 to 3% by weight, for example, from 0.002 to 1% by weight, particularly 0.01 to 1% by weight.

The "thermally gelling substance" means a substance (particularly a polymer substance) which gels in the presence of water at the temperature of at least 30° C., particularly at least 60° C., especially at least 80° C. The "thermally gelling substance" may be a substance, a solution of which has an increased viscosity by the increase of temperature (the viscosity of the thermally gelling substance at the temperature of, for example, at least 30° C., particularly 60° C. or 80° C. is at least two times, at least 10 times the viscosity at the temperature of 20° C.). The thermally gelling substance is a substance which can be dissolved or dispersed in water at 10 to 25° C. (particularly 20° C.). The solubility in water at 25° C. of the thermally gelling substance is generally at least 1 g, preferably at least 2 g, particularly preferably at least 5 g, per 100 g of water. The thermally gelling substance is preferably insoluble in water at the temperature of at least 30° C., particularly at least 60° C., especially at least 80° C. The solubility of the thermally gelling substance in water at 30° C., 60° C. or 80° C. may be at most 0.3 g, particularly at most 0.1 g, per 100 g of water.

Examples of the thermally gelling substance include methyl cellulose, hydroxypropyl methyl cellulose, hydroxyethyl methyl cellulose, ethyl cellulose, ethyl hydroxyethyl cellulose, methyl hydroxypropyl cellulose, polyvinyl alcohol, poly-N-isopropyl acrylamide, and polyvinyl methyl ether. The cellulose compounds are preferable. Particularly, methyl cellulose, hydroxypropyl methyl cellulose, and hydroxyethyl methyl cellulose are preferably.

The viscosity of an aqueous solution of the thermally gelling substance (for example, methyl cellulose) is not particularly limited, but is preferably from 3 mPa·s to 4000 mPa·s (2% aqueous solution, at 20° C., B-type viscometer) in view of handlability.

The amount of the thermally gelling substance may be from 0.1 to 100 parts by weight, for example, from 1 to 50 parts by weight, particularly from 2 to 30 parts by weight, based on 100 parts by weight of the fluorine-containing compound.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The method of the present invention can be suitably used in carpets made of nylon fibers, polypropylene fibers and/or polyester fibers.

The textile may be in any form such as a fiber, a yarn and a fabric. When the carpet is treated according to the method of the present invention, the carpet may be formed after the fibers or yarns are treated according to the present invention, or the formed carpet may be treated according to the present invention. The water- and oil-repellent agent can be used in the state that the fluorine-containing compound is diluted to the content of 0.02 to 30% by weight, preferably 0.02 to 1% by weight.

The "treatment" means that a treatment agent is applied to a substrate. The treatment gives the result that the fluorine-containing compound which is an active component of the treatment agent is penetrated into the internal parts of the substrate and/or adhered to surfaces of the substrate.

PREFERRED EMBODIMENTS OF THE INVENTION

The following Examples further illustrate the present invention in detail but are not to be construed to limit the scope thereof. In the Examples, "%" is "% by weight" unless specified otherwise.

Test procedures of the fluorine adhesion rate, the water-repellency and the oil-repellency are as follows.

Fluorine Adhesion Rate

A combustion flask is sufficiently washed with pure water. Then, 15 mL of pure water is charged into the combustion flask, and the weight of the flask containing water is measured. The weight of pure waster is determined by deducting a previously measured weight of the combustion flask from the weight of flask containing water. A platinum basket is heated twice or thrice to fully evaporate water. 75 mg of a carpet pile is weighed on a KIMWIPE, which is folded with enclosing a combustion aid (30 mg) and is positioned in the platinum basket. Oxygen is blown into the combustion flask, and the piles are burned and decomposed, and absorbed into pure water contained in the flask. After the absorption for 30 minutes, 10 mL of an absorption liquid and 10 mL of a buffer liquid (50 mL of acetic acid, 50 g of sodium chloride, 0.5 g of trisodium citrate dihydrate, and 32 g of sodium hydroxide are added to water to give a total amount of 1 L) are charged into a plastic cup and an F ion is measured by an F ion meter with sufficiently stirring. A fluorine adhesion amount and a fluorine adhesion rate are calculated according to the following equations.

Fluorine adhesion amount [ppm]=(Measurement value [ppm]−Blank measurement value [ppm])×(Pure water weight [g]/Pile weight [mg])×1000

Fluorine adhesion rate (%)=(Fluorine adhesion amount after steam treatment, water wash, centrifugal dehydration and thermal curing treatment [ppm])/(Fluorine adhesion amount immediately after squeezed so that WPU (wet pick up) is 400% or 300% [ppm])

The fluorine adhesion rate is shown as "Exhaust-ability" in the following Tables.

Water-Repellency

A carpet treated with a water- and oil-repellent agent is stored in a thermo-hygrostat having a temperature of 21° C. and a humidity of 65% for at least 4 hours. A test liquid (isopropyl alcohol (IPA), water, and a mixture thereof, as shown in Table I) which has been also stored at 21° C. is used. The test is conducted in an air-conditioned room having a temperature of 21° C. and a humidity of 65%. Droplets of the test liquid in an amount of 50 μL (5 droplets) are softly dropped by a micropipette on the carpet. If 4 or 5 droplets remain on the carpet after standing for 10 seconds, the test liquid passes the test. The water-repellency is expressed by a point corresponding to a maximum content of isopropyl alcohol (% by volume) in the test liquid which passes the test. The water-repellency is evaluated as sixteen levels which are Fail, 0, 0.2, 0.5, 1, 1.5, 2, 2.5, 3, 4, 5, 6, 7, 8, 9 and 10 in order of a bad level to an excellent level.

TABLE I

Water-repellency test liquid

| Point | (% by volume) Isopropyl alcohol | Water |
|---|---|---|
| 10 | 100 | 0 |
| 9 | 90 | 10 |
| 8 | 80 | 20 |
| 7 | 70 | 30 |
| 6 | 60 | 40 |
| 5 | 50 | 50 |
| 4 | 40 | 60 |
| 3 | 30 | 70 |
| 2.5 | 25 | 75 |
| 2 | 20 | 80 |
| 1.5 | 15 | 85 |
| 1 | 10 | 90 |
| 0.5 | 5 | 95 |
| 0.2 | 2 | 98 |
| 0 | 0 | 100 |
| Fail | Inferior to isopropyl alcohol 0/water 100 | |

Oil-Repellency

A carpet treated with a water- and oil-repellent agent is stored in a thermo-hygrostat having a temperature of 21° C. and a humidity of 65% for at least 4 hours. A test liquid (shown in Table II) which has been also stored at 21° C. is used. The test is conducted in an air-conditioned room having a temperature of 21° C. and a humidity of 65%. Droplets of the test liquid in an amount of 50 μL (5 droplets) are softly dropped by a micropipette on the carpet. If 4 or 5 droplets remain on the carpet after standing for 30 seconds, the test liquid passes the test. The oil-repellency is expressed by a maximum point of the test liquid which passes the test. The oil-repellency is evaluated as nine levels which are Fail, 1, 2, 3, 4, 5, 6, 7 and 8 in order of a bad level to an excellent level.

TABLE II

Oil-repellency test

| Point | Test liquid | Surface tension (dyne/cm, 25° C.) |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Mixture liquid of n-Hexadecane 35/nujol 65 | 29.6 |
| 1 | Nujol | 31.2 |
| Fail | Inferior to 1 | — |

Preparative Example 1

$CF_3CF_2(CF_2CF_2)_nCH_2CH_2COOCH{=}CH_2$ (a mixture of compounds wherein n is 3, 4 and 5, the average of n is 3.1) (40 g), stearyl acrylate (10 g), 2-ethylhexyl methacrylate (10 g), glycidyl methacrylate (2 g), N-methylol acrylamide (2 g), 3-chloro-2-hydroxypropyl methacrylate (1 g), n-lauryl mercaptan (0.1 g), sorbitan monolaurate (2 g), ($C_{12}$-$C_{14}$) polyoxyethylene(20)alkyl ether (2 g), ($C_{16}$-$C_{18}$)alkyltrimethyl ammonium chloride (0.5 g), dialkyl (beef tallow) dimethyl ammonium chloride (0.5 g), dipolyoxyethylene benzyl octadecyl ammonium salt (1.5 g), tripropylene glycol (20 g) and ion exchanged water (95 g) were mixed to prepare a mixture liquid. This mixture liquid was heated to 60° C. and then homogenized by a high pressure homogenizer. The resultant emulsified liquid was charged into a 300 mL flask, the atmosphere of the flask was replaced with nitrogen to remove the dissolved oxygen. Then 2,2'-azobis(2-amidinopropane) dihydrochloride (0.5 g) was charged. The copolymerization was performed at 60° C. for 3 hours with stirring to give a copolymer emulsion. The copolymer emulsion was diluted with ion exchanged water to prepare a fluorine-containing acrylate-based water- and oil-repellent agent (that is, an aqueous composition) having a solid content of 30% by weight. The composition of the resultant polymer was almost the same as the composition of the charged monomers.

Preparative Example 2

$CF_3CF_2(CF_2CF_2)_nCH_2CH_2COOCH{=}CH_2$ (a mixture of compounds wherein n is 3, 4 and 5, the average of n is 3.1) (40 g), stearyl acrylate (10 g), 2-ethylhexyl methacrylate (10 g), glycidyl methacrylate (2 g), N-methylol acrylamide (2 g), 3-chloro-2-hydroxypropyl methacrylate (1 g), n-lauryl mercaptan (0.1 g), sorbitan monolaurate (2 g), ($C_{12}$-$C_{14}$) polyoxyethylene(20)alkyl ether (2 g), ($C_{16}$-$C_{18}$)alkyltrimethyl ammonium chloride (0.5 g), dialkyl (beef tallow) dimethyl ammonium chloride (0.5 g), dipolyoxyethylene benzyl octadecyl ammonium salt (1.5 g), tripropylene glycol (20 g), ion exchanged water (95 g) and hydroxypropyl methyl cellulose (Hydroxypropyl methyl cellulose 60SH-03, manufactured by Shin-Etsu Chemical Co., Ltd.) (8 g) were mixed to prepare a mixture liquid. This mixture liquid was heated to 60° C. and then homogenized by a high pressure homogenizer. The resultant emulsified liquid was charged into a 300 mL flask, the atmosphere of the flask was replaced with nitrogen to remove the dissolved oxygen. Then 2,2'-azobis[2-(2-imidazolin-2-yl)propane) dihydrochloride (1.0 g) was charged. The copolymerization was performed at 50° C. for 3 hours with stirring to give a copolymer emulsion. The copolymer emulsion was diluted with ion exchanged water to prepare a fluorine-containing acrylate-based water- and oil-repellent agent (that is, an aqueous composition) having a solid content of 30% by weight. The composition of the resultant polymer was almost the same as the composition of the charged monomers.

Preparative Example 3

$CF_3CF_2(CF_2CF_2)_nCH_2CH_2COOCH{=}CH_2$ (a mixture of compounds wherein n is 3, 4 and 5, the average of n is 3.1) (40 g), stearyl acrylate (10 g), 2-ethylhexyl methacrylate (10 g), glycidyl methacrylate (2 g), N-methylol acrylamide (2 g), 3-chloro-2-hydroxypropyl methacrylate (1 g), n-lauryl mercaptan (0.1 g), sorbitan monolaurate (2 g), ($C_{12}$-$C_{14}$) polyoxyethylene(20)alkyl ether (2 g), ($C_{16}$-$C_{18}$)alkyltrimethyl ammonium chloride (0.5 g), dialkyl (beef tallow) dimethyl ammonium chloride (0.5 g), dipolyoxyethylene benzyl octadecyl ammonium salt (1.5 g), tripropylene glycol (20 g) and ion exchanged water (95 g) were mixed to prepare a mixture liquid. This mixture liquid was heated to 60° C. and then homogenized by a high pressure homogenizer. The resultant emulsified liquid was charged into a 300 mL flask, the atmosphere of the flask was replaced with nitrogen to remove the dissolved oxygen. Then 2,2'-azobis(2-amidinopropane) dihydrochloride (0.5 g) was charged. The copolymerization was performed at 60° C. for 3 hours with stirring to give a copolymer emulsion. The copolymer emulsion was diluted with ion exchanged water to prepare a fluorine-containing acrylate-based water- and oil-repellent agent (that is, an aqueous composition) having a solid content of 30% by weight. Hydroxypropyl methyl cellulose (Hydroxypropyl methyl cellulose 60SH-03, manufactured by Shin-Etsu Chemical Co., Ltd.) (8 g) was added to the resultant composition.

Example 1

The fluorine-containing acrylate-based water- and oil-repellent agent (0.13 g) prepared in Preparative Example 1, a 1 wt % aqueous solution of methyl cellulose (Methyl cellulose SM-15, manufactured by Shin-Etsu Chemical Co., Ltd.) (0.5 g) and water (99.73 g) were mixed to prepare a mixture liquid and a 10% aqueous solution of sulfamic acid was added so that the mixture had pH of at most 2 to give a treatment liquid.

A carpet which was washed with water and dehydrated to WPU of 25% (WPU: wet pick up; when 100 g of the carpet absorbs 25 g of a liquid, WPU is 25%) was immersed in the above-mentioned treatment liquid for 30 seconds so that WPU was 250%. Then, an atmospheric pressure steam treatment (temperature: 100° C. to 107° C.) was conducted for 60 seconds under the state that a pile surface was upward. The carpet was lightly rinsed with 2 L of water and then centrifugal dehydration was conducted to give a WPU amount of 25%. Finally, the carpet was thermally treated at 110° C. for 10 minutes. The carpet was three types of polyester (15 cm×5 cm, cut pile, density of 44 oz/yd$^2$), nylon-6 (15 cm×5 cm, cut pile, density of 32 oz/yd$^2$) and polypropylene (15 cm×5 cm, cut pile, density of 38 oz/yd$^2$).

The resultant carpets were subjected to a fluorine adhesion rate measurement, a water-repellency test and an oil-repellency test. The results are shown in Tables 1, 2 and 3.

Example 2

The carpet was treated in the same manner as in Example 1 except that the amount of the fluorine-containing acrylate-based water- and oil-repellent agent prepared in Preparative Example 1 was changed to 0.13 g, and 0.5 g of a 1% aqueous solution of hydroxypropyl methyl cellulose (Hydroxypropyl methyl cellulose 60SH-03, manufactured by Shin-Etsu Chemical Co., Ltd.) was used instead of methyl cellulose.

The resultant carpets were subjected to a fluorine adhesion rate measurement, a water-repellency test and an oil-repellency test. The results are shown in Tables 1, 2 and 3.

Example 3

The carpet was treated in the same manner as in Example 1 except that the amount of the fluorine-containing acrylate-based water- and oil-repellent agent prepared in Preparative Example 1 was changed to 0.13 g, and 0.5 g of a 1 wt % aqueous solution of hydroxyethyl methyl cellulose (Hydroxyethyl methyl cellulose SEB-04T, manufactured by Shin-Etsu Chemical Co., Ltd.) was used instead of methyl cellulose.

The resultant carpets were subjected to a fluorine adhesion rate measurement, a water-repellency test and an oil-repellency test. The results are shown in Tables 1, 2 and 3.

Example 4

The fluorine-containing acrylate-based water- and oil-repellent agent (0.13 g) prepared in Preparative Example 2 and water (99.73 g) were mixed to prepare a mixture liquid and a 10% aqueous solution of sulfamic acid was added so that the mixture had pH of at most 2 to give a treatment liquid.

A carpet (15 cm×5 cm, nylon-6, cut pile, density of 32 oz/yd$^2$) which was washed with water and dehydrated to WPU of 25% (WPU: wet pick up; when 100 g of the carpet absorbs 25 g of a liquid, WPU is 25%) was immersed in the above-mentioned treatment liquid for 30 seconds so that WPU was 250%. Then, an atmospheric pressure steam treatment (temperature: 100° C. to 107° C.) was conducted for 60 seconds under the state that a pile surface was upward. The carpet was lightly rinsed with 2 L of water and then centrifugal dehydration was conducted to give a WPU amount of 25%. Finally, the carpet was thermally treated at 110° C. for 10 minutes.

The resultant carpet was subjected to a fluorine adhesion rate measurement, a water-repellency test and an oil-repellency test. The results are shown in Table 1.

Example 5

The carpet was treated in the same manner as in Example 4 except that the fluorine-containing acrylate-based water- and oil-repellent agent prepared in Preparative Example 3 was used.

The resultant carpet was subjected to a fluorine adhesion rate measurement, a water-repellency test and an oil-repellency test. The results are shown in Table 1.

Comparative Example 1

The carpet was treated in the same manner as in Example 1 except that the solution of methyl cellulose was not added to 0.13 g of the fluorine-containing acrylate-based water- and oil-repellent agent prepared in Preparative Example 1.

The resultant carpets were subjected to a fluorine adhesion rate measurement, a water-repellency test and an oil-repellency test. The results are shown in Tables 1, 2 and 3.

TABLE 1

| Polyester | | | |
|---|---|---|---|
| | Exhaustability (adhesion rate) (%) | Water repellency | Oil repellency |
| Example 1 | 82 | 9 | 5 |
| Example 2 | 87 | 8 | 4 |
| Example 3 | 92 | 10 | 6 |
| Example 4 | 85 | 10 | 6 |
| Example 5 | 97 | 8 | 4 |
| Comparative Example 1 | 42 | 3 | 2 |

TABLE 2

| Nylon | | | |
|---|---|---|---|
| | Exhaustability (adhesion rate) (%) | Water repellency | Oil repellency |
| Example 1 | 80 | 7 | 4 |
| Example 2 | 85 | 6 | 5 |
| Example 3 | 89 | 8 | 4 |
| Comparative Example 1 | 41 | 2 | 1 |

TABLE 3

| Polypropylene | | | |
|---|---|---|---|
| | Exhaustability (adhesion rate) (%) | Water repellency | Oil repellency |
| Example 1 | 80 | 4 | 3 |
| Example 2 | 87 | 6 | 4 |
| Example 3 | 82 | 5 | 4 |
| Comparative Example 1 | 35 | 2 | 1 |

The invention claimed is:

1. A method of producing a treated textile, comprising steps of:

(1) preparing a treatment liquid comprising a water- and oil-repellent agent which comprises a fluorine-containing polymer, (2) adjusting pH of the treatment liquid to at most 7, (3) applying the treatment liquid to a textile, (4) treating the textile with steam, and (5) washing the textile with water and dehydrating the textile, wherein the water- and oil-repellent agent or the treatment liquid comprises a thermally gelling substance, or, in the step (3), the thermally gelling substance is used in addition to the treatment liquid and the thermally gelling substance is applied to the textile with contacting the thermally gelling substance with the treatment liquid, the thermally gelling substance is at least one cellulose compound selected from the group consisting of methyl cellulose, hydroxypropyl methyl cellulose, hydroxyethyl methyl cellulose, ethyl cellulose, ethyl hydroxyethyl cellulose, and methyl hydroxypropyl cellulose, the fluorine-containing polymer comprises:

(I) a repeating unit derived from a monomer having a fluoroalkyl group, and (II) a repeating unit derived from a fluorine-free monomer, and/or (III) a repeating unit derived from a crosslinkable monomer, and the fluoroalkyl group-containing monomer is of the formula:

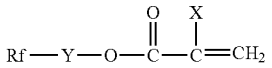

(I)

wherein X is a hydrogen atom, a methyl group, a fluorine atom, a chlorine atom, a bromine atom, a iodine atom, $CFX^1X^2$ group (in which $X^1$ and $X^2$ are a hydrogen atom, a fluorine atom, a chlorine atom, a bromine atom or a iodine atom), a cyano group, a linear or branched fluoroalkyl group having 1 to 21 carbon atoms, a substituted or unsubstituted benzyl group, or a substituted or unsubstituted phenyl group, Y is an aliphatic group having 1 to 10 carbon atoms, an aromatic group or cycloaliphatic group having 6 to 10 carbon atoms, a $—SO_2N(R^1)CH_2CH_2—$ group (in which $R^1$ is an alkyl group having 1 to 4 carbon atoms) or a $—CH_2CH(OY^1)CH_2—$ group (in which $Y^1$ is a hydrogen atom or an acetyl group), and Rf is a linear or branched fluoroalkyl group having 1 to 21 carbon atoms, and wherein the fluorine-containing polymer is free from an oxyalkylene group; and wherein the amount of the repeating unit (II) is from 0 to 200 parts by weight, and the amount of the repeating unit (III) is from 0 to 30 parts by weight, based on 100 parts by weight of the repeating unit (I), and the amount of the thermally gelling substance is from 0.1 to 100 parts by weight, based on 100 parts by weight of the fluorine-containing polymer.

2. The method according to claim 1, wherein the thermally gelling substance is a material which gels in the presence of water at the temperature of at least 30° C.

3. The method according to claim 1, wherein the thermally gelling substance is insoluble in water at the temperature of at least 30° C.

4. The method according to claim 1, wherein the thermally gelling substance is at least one material selected from the group consisting of methyl cellulose, hydroxypropyl methyl cellulose, and hydroxyethyl methyl cellulose.

5. The method according to claim 1, wherein, in the fluoroalkyl group-containing monomer (I), Y is an aliphatic group having 1 to 10 carbon atoms.

6. The method according to claim 1, wherein the fluorine-free monomer (II) is at least one selected from the group consisting of ethylene, vinyl acetate, vinyl halide, vinylidene halide, acrylonitrile, styrene, polyethyleneglycol (meth) acrylate, polypropyleneglycol (meth)acrylate, methoxypolyethyleneglycol (meth)acrylate, methoxypolypropyleneglycol (meth)acrylate, vinyl alkyl ether, isoprene and a (meth) acrylate ester having an alkyl group.

7. The method according to claim 1, wherein the crosslinkable monomer (III) is at least one selected from the group consisting of diacetoneacrylamide, (meth)acrylamide, N-methylol-acrylamide, hydroxymethyl (meth)acrylate, hydroxyethyl (meth)acrylate, 3-chloro-2-hydroxypropyl (meth)acrylate, N,N-dimethylaminoethyl (meth)acrylate, N,N-diethylamino-ethyl (meth)acrylate, butadiene, chloroprene and glycidyl (meth)acrylate.

8. The method according to claim 1, wherein the fluorine-containing polymer consists essentially of the repeating units (I) and, (II) and/or (III).

9. The method according to claim 1, wherein, in the fluoroalkyl group-containing monomer (I), the carbon number of the Rf group is from 1 to 6.

10. The method according to claim 1, wherein the fluorine-containing polymer consists of (I) the repeating unit derived from a monomer having a fluoroalkyl group and one or both of (II) the repeating unit derived from a fluorine-free monomer and (III) the repeating unit derived from a crosslinkable monomer.

11. The method according to claim 1, wherein the fluorine-free monomer (II) is at least one selected from the group consisting of vinyl halide and vinylidene halide, and the amount of the repeating unit (II) is 0.5 to 80 parts by weight, based on 100 parts by weight of the repeating unit (I).

12. The method according to claim 1, wherein the fluorine-free monomer (II) is vinyl chloride.

13. A textile obtained by the method according to claim 1.

14. The textile according to claim 13, which is a carpet.

15. The textile according to claim 14, wherein the carpet comprises nylon fibers, polypropylene fibers and/or polyester fibers.

16. A treatment liquid for use in a method of treating a textile, comprising:

(i) a water- and oil-repellent agent which comprises a fluorine-containing polymer, and (ii) a thermally gelling substance, wherein the method comprises steps of:

(1) preparing the treatment liquid comprising the water- and oil-repellent, (2) adjusting pH of the treatment liquid to at most 7, (3) applying the treatment liquid to a textile, (4) treating the textile with steam, and (5) washing the textile with water and dehydrating the textile, wherein the thermally gelling substance is at least one cellulose compound selected from the group consisting of methyl cellulose, hydroxypropyl methyl cellulose, hydroxyethyl methyl cellulose, ethyl cellulose, ethyl hydroxyethyl cellulose, and methyl hydroxypropyl cellulose, the fluorine-containing polymer comprises:

(I) a repeating unit derived from a monomer having a fluoroalkyl group, and (II) a repeating unit derived from a fluorine-free monomer, and/or (III) a repeating unit derived from a crosslinkable monomer, and the fluoroalkyl group-containing monomer is of the formula:

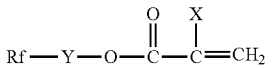

(I)

wherein X is a hydrogen atom, a methyl group, a fluorine atom, a chlorine atom, a bromine atom, a iodine atom, $CFX^1X^2$ group (in which $X^1$ and $X^2$ are a hydrogen atom, a fluorine atom, a chlorine atom, a bromine atom or a iodine atom), a cyano group, a linear or branched fluoroalkyl group having 1 to 21 carbon atoms, a substituted or unsubstituted benzyl group, or a substituted or unsubstituted phenyl group, Y is an aliphatic group having 1 to 10 carbon atoms, an aromatic group or cycloaliphatic group having 6 to 10 carbon atoms, a $—SO_2N(R^1)CH_2CH_2—$ group (in which $R^1$ is an alkyl group having 1 to 4 carbon atoms) or a $—CH_2CH(OY^1)CH_2—$ group (in which $Y^1$ is a hydrogen atom or an acetyl group), and Rf is a linear or branched fluoroalkyl group having 1 to 21 carbon atoms, wherein the fluorine-containing polymer is free from an oxyalkylene group; and wherein the amount of the repeating unit (II) is from 0 to 200 parts by weight, and the amount of the repeating unit (III) is from 0 to 30 parts by weight, based on 100 parts by weight of the repeating unit (I), and the amount of the thermally gelling substance is from 0.1 to 100 parts by weight, based on 100 parts by weight of the fluorine-containing polymer.

17. The treatment liquid according to claim 16, wherein the thermally gelling substance is added to a polymerizable monomer before the polymerization of the fluorine-containing polymer, whereby the water- and oil-repellent agent is prepared.

18. The treatment liquid according to claim 16, wherein after the fluorine-containing polymer is polymerized, the water- and oil-repellent agent is prepared by adding the thermally gelling substance to the fluorine-containing polymer.

19. The treatment liquid according to claim 16, wherein the thermally gelling substance is added to the water- and oil repellent agent to prepare the treatment liquid.

20. The treatment liquid according to claim 16, wherein, in the fluoroalkyl group-containing monomer (I), Y is an aliphatic group having 1 to 10 carbon atoms.

21. The treatment liquid according to claim 16, wherein the fluorine-free monomer (II) is at least one selected from the group consisting of ethylene, vinyl acetate, vinyl halide, vinylidene halide, acrylonitrile, styrene, polyethyleneglycol (meth)acrylate, polypropyleneglycol (meth)acrylate, methoxypolyethyleneglycol (meth)acrylate, methoxypolypropyleneglycol (meth)acrylate, vinyl alkyl ether, isoprene and a (meth)acrylate ester having an alkyl group.

22. The treatment liquid according to claim 16, wherein the crosslinkable monomer (III) is at least one selected from the group consisting of diacetoneacrylamide, (meth)acrylamide, N-methylol-acrylamide, hydroxymethyl (meth)acrylate, hydroxyethyl (meth)acrylate, 3-chloro-2-hydroxypropyl (meth)acrylate, N,N-dimethylaminoethyl (meth) acrylate, N,N-diethylamino-ethyl (meth)acrylate, butadiene, chloroprene and glycidyl (meth)acrylate.

23. The treatment liquid according to claim 16, wherein the fluorine-containing polymer consists essentially of the repeating units (I) and, (II) and/or (III).

24. The treatment liquid according to claim 16, wherein, in the fluoroalkyl group-containing monomer (I), the carbon number of the Rf group is from 1 to 6.

25. The treatment liquid according to claim 16, wherein the fluorine-containing polymer consists of (I) the repeating unit derived from a monomer having a fluoroalkyl group and one or both of (II) the repeating unit derived from a fluorine-free monomer and (III) the repeating unit derived from a crosslinkable monomer.

26. The treatment liquid according to claim 16, wherein the fluorine-free monomer (II) is at least one selected from the group consisting of vinyl halide and vinylidene halide, and the amount of the repeating unit (II) is 0.5 to 80 parts by weight, based on 100 parts by weight of the repeating unit (I).

27. The treatment liquid according to claim 16, wherein the fluorine-free monomer (II) is vinyl chloride.

* * * * *